US005248392A

United States Patent [19]

Bando et al.

[11] Patent Number: 5,248,392

[45] Date of Patent: Sep. 28, 1993

[54] SHEET-FORMING APPARATUS FOR A TWIN WIRE PAPER MACHINE WITH POSITIVE PULSE SHOE BLADES

[75] Inventors: Takashi Bando, Mihara; Hiroshi Suzumura; Hiroshi Iwata, both of Hiroshima, all of Japan

[73] Assignee: Mitsubishi Jukogyo Kabushiki Kaisha, Tokyo, Japan

[21] Appl. No.: 949,767

[22] Filed: Sep. 22, 1992

Related U.S. Application Data

[63] Continuation of Ser. No. 735,421, Jul. 25, 1991, abandoned.

[30] Foreign Application Priority Data

Jul. 30, 1990 [JP] Japan ..... 2-199230

[51] Int. Cl.[5] ..... D21F 1/00; D21F 1/54

[52] U.S. Cl. ..... 162/301; 162/300; 162/352

[58] Field of Search ..... 162/300, 301, 303, 352, 162/374

[56] References Cited

U.S. PATENT DOCUMENTS

| | | | |
|---|---|---|---|
| 3,874,998 | 4/1975 | Johnson | 162/352 |
| 3,944,464 | 3/1976 | Means | 162/301 |
| 3,992,190 | 11/1975 | Cowan | 162/374 |
| 4,134,788 | 1/1979 | Witworth | 162/374 |
| 4,447,296 | 5/1984 | Cruse | 162/352 |
| 4,523,978 | 6/1985 | Pullinen | 162/301 |
| 4,623,429 | 11/1986 | Tissari | 162/301 |
| 4,790,909 | 12/1988 | Harwood | 162/301 |
| 4,999,087 | 3/1991 | Ebihara et al. | 162/301 |

FOREIGN PATENT DOCUMENTS

| | | | |
|---|---|---|---|
| 3315023 | 11/1983 | Fed. Rep. of Germany . | |
| 1075898 | 4/1986 | Japan | 162/348 |
| 2-133689 | 2/1990 | Japan . | |
| 8606117 | 10/1986 | PCT Int'l Appl. .. | |
| 1382791 | 2/1975 | United Kingdom . | |
| 2124669 | 2/1984 | United Kingdom | 162/352 |

*Primary Examiner*—Karen M. Hastings
*Attorney, Agent, or Firm*—McAulay Fisher Nissen Goldberg & Kiel

[57] ABSTRACT

A twin wire sheet-forming apparatus for a paper machine having at least two fixed hydroextractors which have separate places for drainage to the hydroextractor side from places for dispersion of fibers. These hydroextractors are arranged alternately in the two wire loops, and have shoe blades, with a wedge shaped trough in a mid-portion of each shoe blade. The wires do not bend at a front leading portion of each shoe, yet do bend at the mid-portion or back portion of each shoe for generating a pressure pulse to disperse the fibers.

3 Claims, 5 Drawing Sheets

SHEET-FORMING APPARATUS FOR A TWIN WIRE PAPER MACHINE WITH POSITIVE PULSE SHOE BLADES

This is a continuation, of application Ser. No. 07/735,421, filed Jul. 25, 1991, abandoned.

FIELD OF THE INVENTION AND RELATED ART STATEMENT

The present invention relates to a sheet-forming apparatus for a paper machine having characteristics in the fixed hydroextractors and their arrangements.

In a twin wire former as a sheet-forming apparatus for a paper machine, two sheets of wire form respective loops, between which the raw material liquid is held and run; while the running, water is removed from the raw material liquid by various hydroextractors whereby fibers mat grows gradually and web is formed.

Above description is illustrated further for a case of a sheet-forming apparatus having a fixed hydroextractor of conventional shoe type shown in FIG. 5. In the apparatus, two sheets of wire 1, 2 form a gap 5 in a wedge shape guided by rolls 3, 4 respectively. Thereafter the wires become constricted and completely overlapped on shoe blades 9 arranged on a certain curvature R as a part of the first fixed hydroextractor 8, running in bent along the curve of approximate radius R.

On the other hand, the raw material jet (raw material liquid) 7 is injected from headbox 6 toward gap 5 and held between the two sheets of wires 1, 2 and runs at the same speed as the wires. And initial drainage starts when the raw material jet 7 is held between the two sheets of wires 1, 2 by squeezing caused by the wire tension. However, most of the drainage is done on subsequent shoe blades 9 by the pressure applied to the raw material liquid held between the wires.

Afterwards, the raw material liquid is further drained at suction roll 12 that is the second hydroextractor and turned into a wet sheet 13 and transferred to the next step press part in a state on the wire 2. In FIG. 5, 10 is a water deflector and 11 is a low vacuum box for draining by vacuum.

Structure and drainage effect of the hydroextractors are explained next. FIGS. 6 and 7 show two examples of typical prior art arrangement of the blades and model curves in respective examples illustrating the pressure applied to the raw material liquid between the wires.

In FIGS. 6 and 7, the shoe blade 9 is detachable through a guide of the supporter 14 fixed in the hydroextractor 8 and arranged so that the surface on the center line is to be on a certain curvature R. Therefore, the number of blades and the pitch are adjustable. Bent angles $\theta_1$ and $\theta_2$ at which the wires 1 and 2 bend at the front edge and at the back edge vary depending on the pitch (refer to FIG. 7). The greater the pitch is, the greater become the angles; the peak value of the generated pressure becomes greater accordingly. By the pressure, fibers in the raw material liquid held between the wires 1 and 2 are moved and dispersed further; simultaneously water is drained through the two sheets of wire to both sides.

The drainage is done in both directions to the wire 1 side and the wire 2 side in a course between the shoe blades; while only to the wire 1 side in a course on the shoe blade 9 because draining to the wire 2 side is inhibited by the shoe blade 9 as illustrated by arrow marks in FIGS. 6 and 7. Fibers in the raw material liquid are divided into those forming sheet as mat and those being washed out with white water (liquid mixture of drained water and fiber content).

It has been understood that prior art fiber mat, formed by the pressure applied in the raw material liquid held between two sheets of the wires 1 and 2 during the drainage at the part of shoe blades 9, is same both in the wire 1 side and in the wire 2 side. However, actual effects of the shoe blade 9 to the mats formed on the wire 1 surface and on the wire 2 are not always same. That is, the two sheets of wires 1 and 2 swell at the front edge and at the back edge by respective applied pressure $P_1$ and $P_2$ as shown in FIG. 8. At this occasion, fibers near the boundary of the wire 1 and the fiber mat 15' formed on the wire 1 side run with the wire while being fixed as the mat. On the other hand, the fiber mat 15'' on the wire 2 side receives the reaction force through the wire 2, when the wire 2 is scraped at the front edge of shoe blade 9. By that force, fibers in the mat are moved further and dispersed; whereby short fibers losing connection with long fibers tend to be washed out with water drained by the pressure $P_1$ to the mat 15'', resulting in lower yield tendency of the short fiber compared with the wire 1 side.

In a prior art sheet-forming apparatus, a fixed hydroextractor 8 of the above mentioned drainage characteristics is located only inside the wire 2 loop as shown in FIG. 5; thus, top side tends to differ from back side in the formed papers. In order to mitigate these problems, paper industries are now managing with adopting different specification for wire 1 from wire 2, mesh of wire 2 being finer than wire 1, that is, wire 2 has more weaves.

OBJECT AND SUMMARY OF THE INVENTION

The object of the present invention is to provide a sheet-forming apparatus for a paper machine resolving the prior art problems explained above, improving the fiber yield and also improving the difference between top side and wire side of the papers.

For this purpose, the present invention provides a sheet-forming apparatus of paper machine apparatus having at least two fixed hydroextractors which have separate places for drainage to the hydroextractor side and for dispersion of fibers; the hydroextractors are arranged alternately in the two wire loops.

The front edge of the shoe blade according to the present invention is formed so that the wires proceed without bending. Therefore, the front edge functions only for scraping white water as is a foil blade of a fourdrinier paper machine. The pitch at which the shoe blades are installed is narrower than that of a fourdrinier paper machine. Thereby, deflection of the wires become far smaller and degree of the scraping becomes also smaller compared with prior art apparatus. Thus, pressure generation between the shoe blades such as of prior art type is small and the shearing force applied to the raw material liquid held between the wires is also small. Drainage by means of applying vacuum to the space between the blades improves the fiber yield since the drainage conditions is quite same as drainage of stable raw material liquid under vacuum.

By way of bending the wires at an intermediate position or at the back edge of the shoe blades, pressure in a pulse form necessary for further dispersion of the fibers in the raw material liquid is generated in the same manner as a conventional apparatus; and drainage to the shoe blade side at this part is restricted. Thus, the place where drainage to the hydroextractor is made and the place where fibers are dispersed are separated.

The fixed hydroextractors equipped with shoe blades are arranged alternately within the wire loop. Thereby, the effects of the shoe blades are directed to the both sides of the mat being formed alternately and thus, there develops no difference between the top side and the back side of the paper. Initial set for the first fixed hydroextractor and for the second hydroextractor is made so that the two sheets of the wire should not be bent at the back edge position of the last end of the first hydroextractor and at the front end position of the second fixed hydroextractor. However, the wire tends to bend during operations due to added thickness of the raw material. As the countermeasures, the structure of the the second fixed hydroextractor is made so as to move rotationally around a center near the back end. Thereby, the wire can be supported without bending by adjusting the position of the front end in accordance with the thickness of the proceeding raw material.

DETAILED DESCRIPTION OF PREFERRED EMBODIMENTS

Hereunder the present invention is illustrated by an example shown in accompanying drawings.

Figure 1:
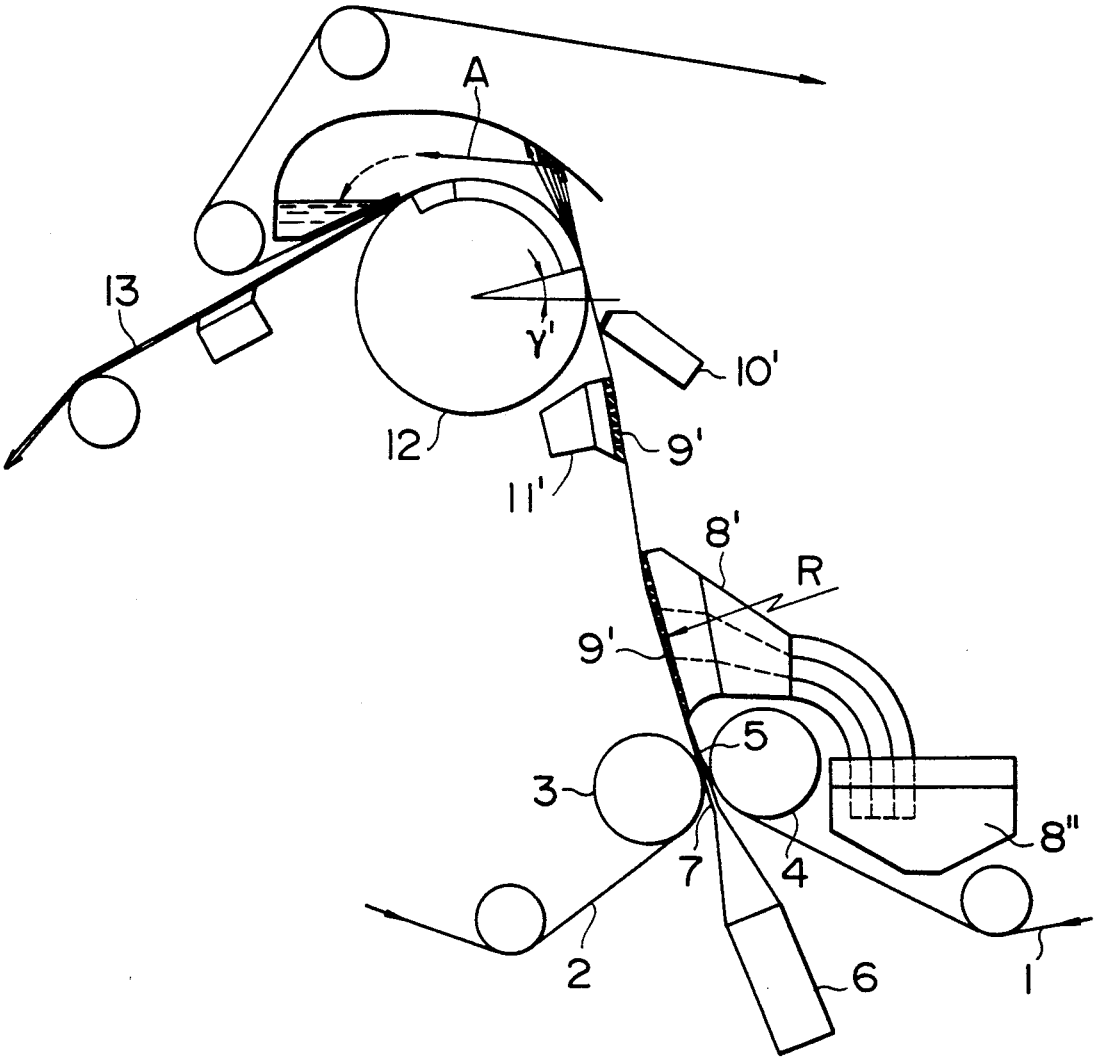
FIG. 1 is a side view of an example of the whole sheet-forming apparatus according to the present invention.
Figure 2:
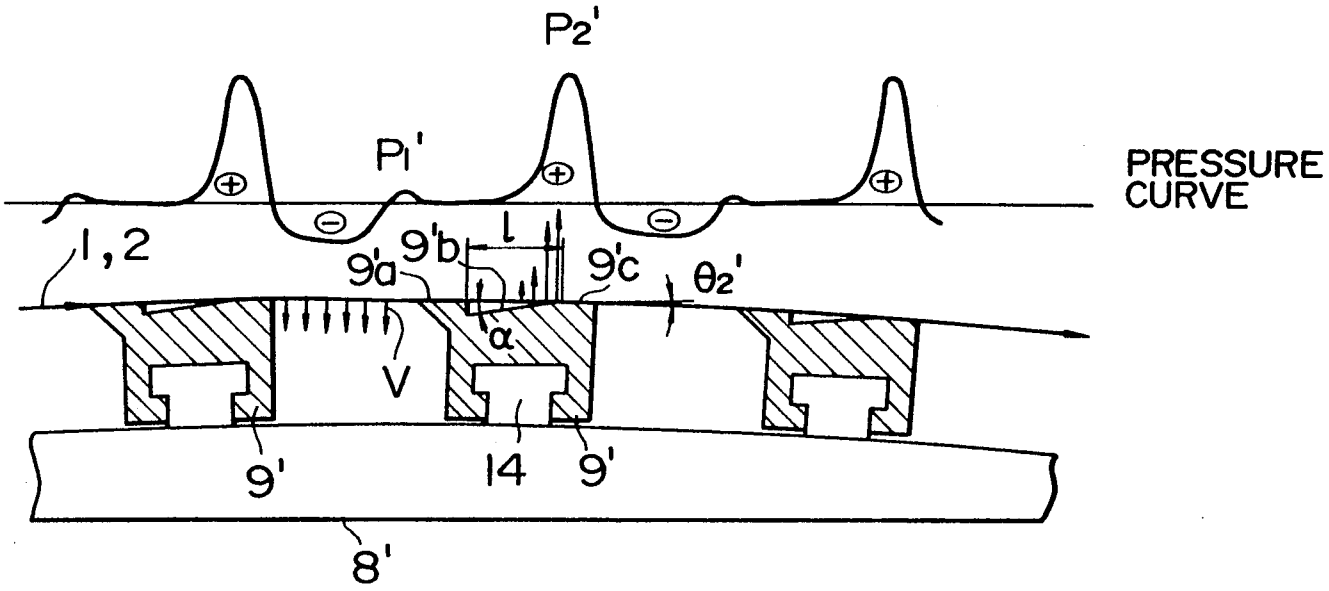
FIG. 2 is a detailed lateral section view of the first example of the hydroextractor according to the present invention.
Figure 3:
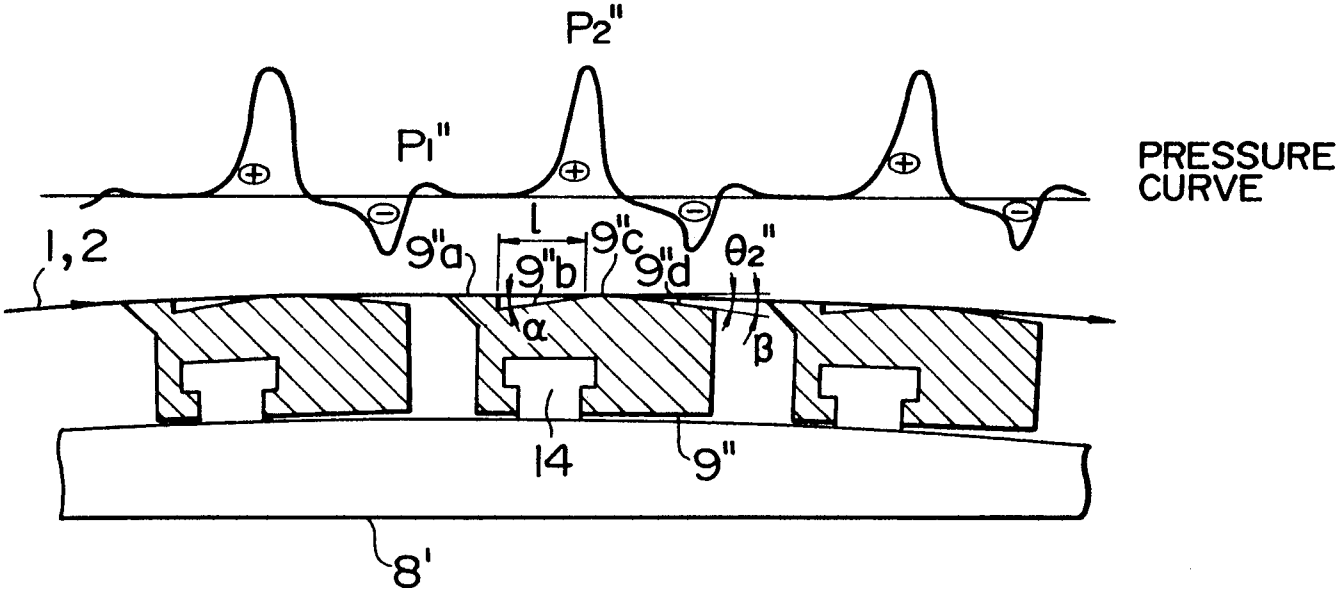
FIG. 3 is a detailed lateral section view of the second example hydroextractor according to the present invention.
Figure 4:
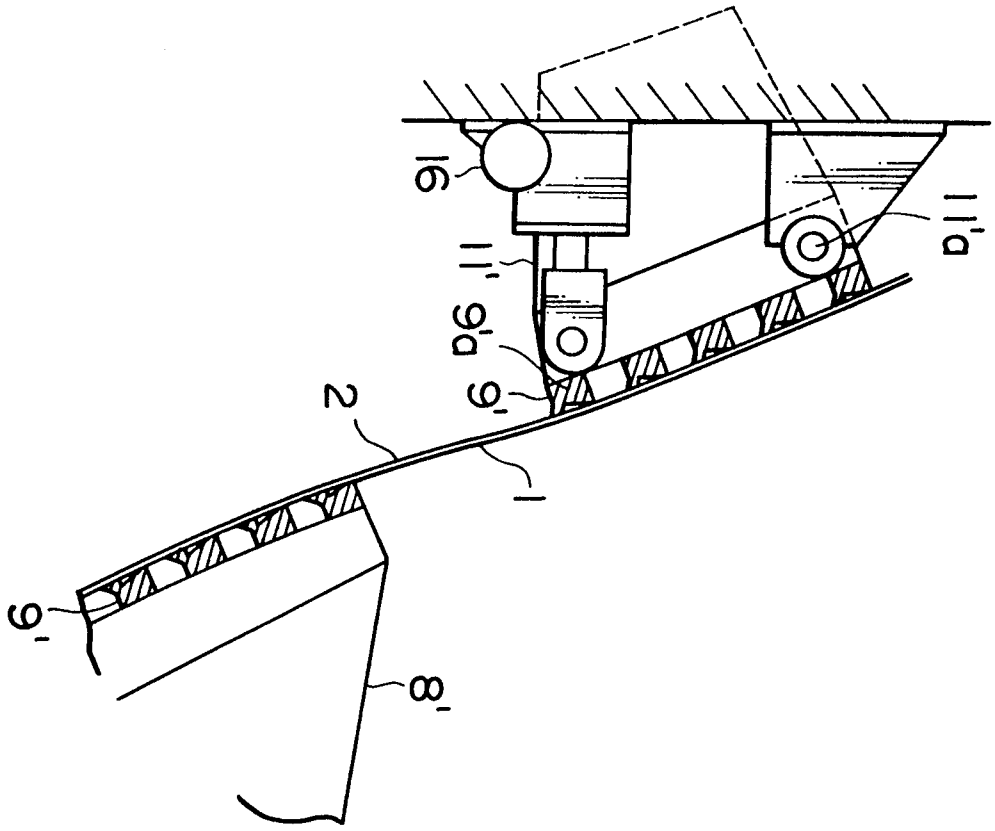
FIG. 4 is a detailed lateral section view of the second fixed hydroextractor of the Example according to the present invention.
Figure 5:
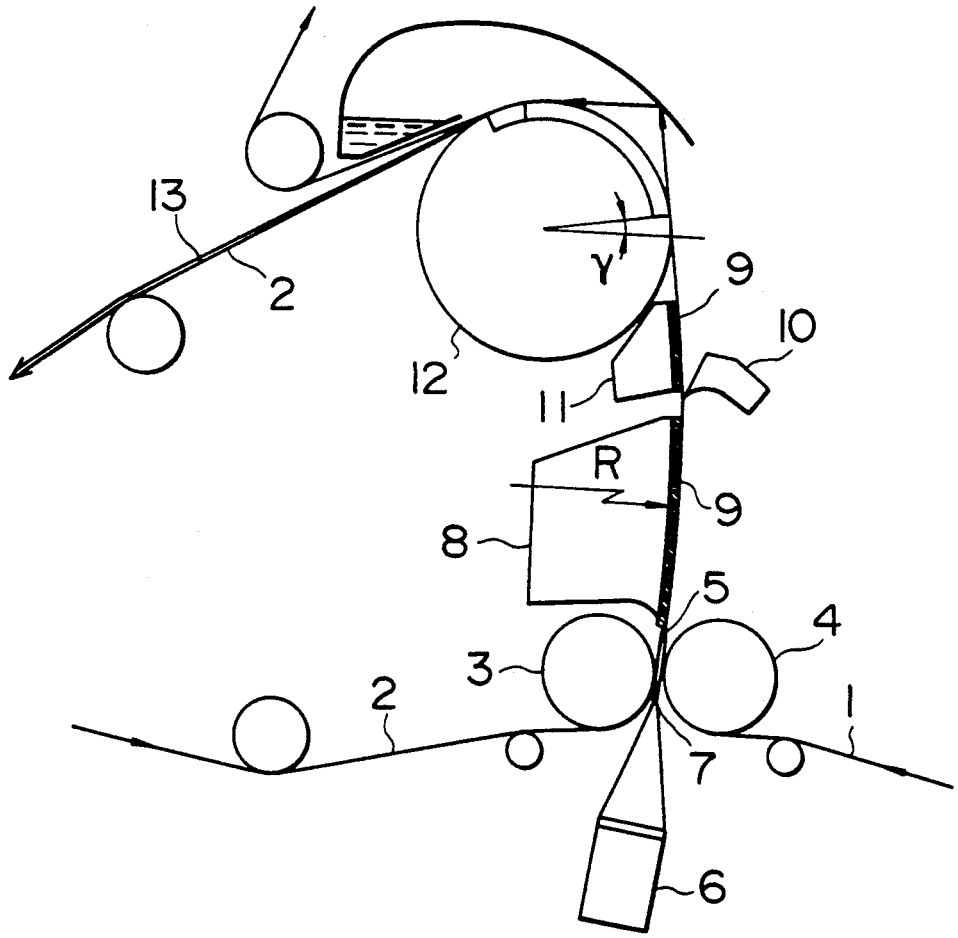
FIG. 5 PRIOR ART
FIG. 5 is a side view of whole sheet-forming apparatus having a prior art fixed hydroextractor of shoe type.
Figure 6:
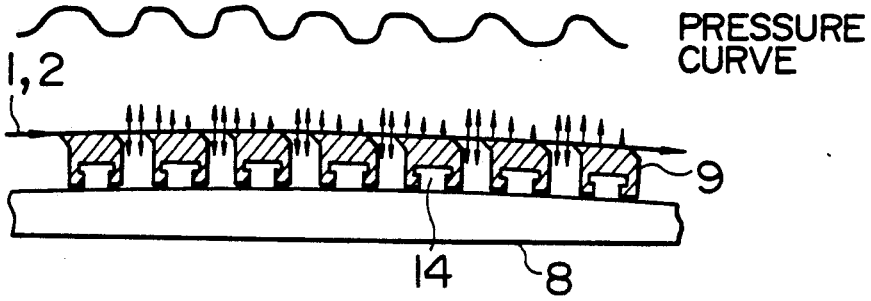
FIG. 6 PRIOR ART
FIG. 6 is a detailed lateral section view of a prior art fixed hydroextractor.
Figure 7:
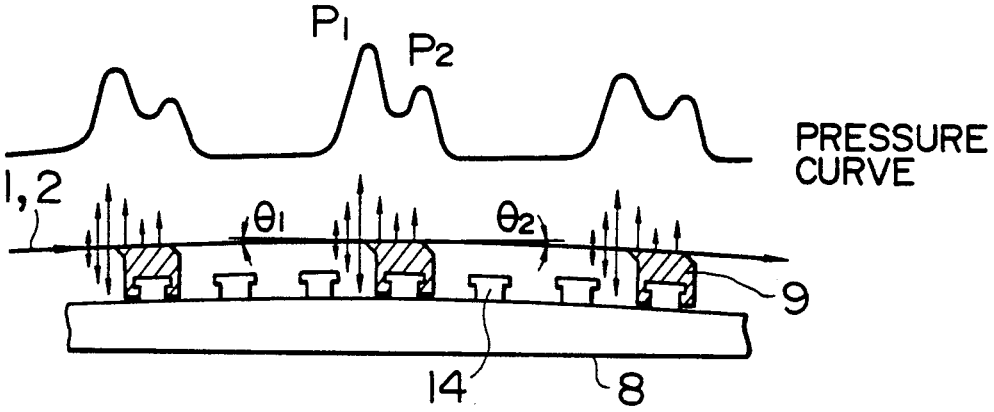
FIG. 7 PRIOR ART
FIG. 7 is a detailed lateral section view of a prior art fixed hydroextractor.
Figure 8:
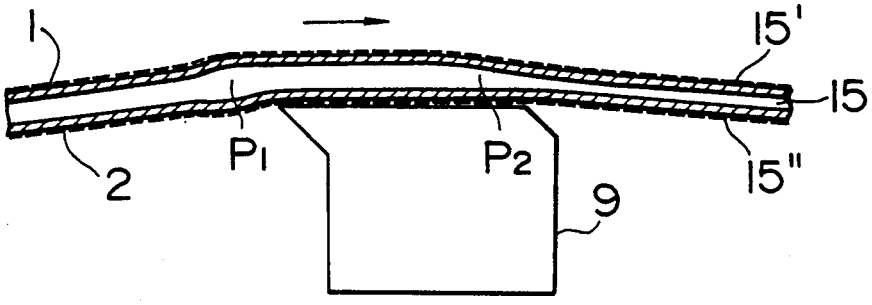
FIG. 8 PRIOR ART
FIG. 8 is an enlarged side view of a shoe blade part of a prior art fixed hydroextractor.

As for one example of sheet-forming apparatus of paper machine having hydroextractors according to the present invention: whole assembly is shown in FIG. 1; function details are shown in FIG. 2 and FIG. 3; detailed drawing for the device to decide location of the front edge of the second fixed hydroextractor is shown in FIG. 4. Constituting members shown in the number 1 through 7 in FIG. 1 are identical with FIG. 5 and function in quite same ways. Thus, detailed explanation for these is omitted here. 8'' is save-all to recover drained white water.

In FIG. 2, front edge 9'a of shoe blade 9' is located so as to be in the same plane as wire 2. Therefore, wire 1 and 2, between which raw material liquid is held, proceed to shoe blade front edge 9'a without bending of wire 1 and 2 at the front end. Thus, only small pressure ($P_1'$) due to the collision reactive force of white water is generated unlike large pressure at front edge of prior art shoe blade 9; and the shearing force applied to mat between the wire is also small.

Vacuum is applied to the space between shoe blades 9'. Therefore, drainage between shoe blades 9' is nearly same as static drainage.

Thus, drainage V resulting from this part is done separately from the place of the fiber dispersion, that is, in nearly the same manner as static drainage, with a high yield.

Wires 1 and 2 holding a raw material liquid 15 that has passed front edge 9'a of the shoe blade bend at the front side of back edge 9'c with the angle of $\theta_2'$. The shape of the back edge 9'c is made so that wires 1 and 2 should bend in this way. In this procedure, a pulse pressure is generated due to the same action as in the prior art shoe blade whereby further dispersion of fibers in the mat is promoted.

The peak pressure value is adjustable by installing a first land portion of 9'b of inclined concave shape between the front edge 9'a and the back edge 9'c of shoe blade 9' and by changing the shape parameter (1, $\alpha$) governing the wedge-shaped space comprising the inclined bottom surface and the wire 1. This is apparent from a prior art disclosure (Japanese Patent Provisional Publication No. 133689/1990 (2-133689)).

The part near back edge 9'c of the shoe blade in said wedge-shaped space, which is of positive pressure $P_2'$ to the raw material liquid between the wires, is filled with the white water once drained as taught in said prior art disclosure. Thus, dropping out of short fibers, which often occurs at prior art shoe blades, is avoided and the yield at the shoe blade side is improved according to the present invention.

FIG. 3 shows another example of a shoe blade attaining the object of the present invention. Functions of 9''a through 9''c in FIG. 3 are same as those of 9'a through 9'c in FIG. 2. Shoe blade 9'' has a second land part 9''d declining toward the downstream similar to a foil blade of fourdrinier paper machine. Vacuum force generated in the space formed by the second land part 9''d and wire 1 remove water, saving the vacuum force. The drainage capacity is adjustable by changing angle $\beta$ as is the case of fourdrinier paper machine.

The raw material liquid held between the wires 1 and 2 passing through the first hydroextractor 8' toward down stream reaches front edge of No. 1 shoe blade 9'a fixed on the second fixed hydroextractor 11'. The second fixed hydroextractor 11' is supported, as shown in FIG. 4, by a rotatable support device 16 of which supporting point 11'a is located at near the back end and is set so that the wire 2 proceeds without bending at the front edge position of No. 1 (the front end) shoe blade 9'a by way of making the wire 2 at a distance of the thickness of raw material from the shoe-blade. The rotatable position is adjusted by detecting the white water taken out at said front edge. Thus, white water is taken out at the front end without scraping the formed mat on the wire 2 side. Further, on the second fixed hydroextractor 11', the wire 2 side (that was outside at the first fixed hydroextractor 8' part) of raw material liquid held between wire 1 and 2 is subjected to draining action as explained above while running on the surface of shoe blade 9'.

Thus, the mat running after the second hydroextractor 11' has same history in both sides and difference between top side and back side is smaller, resulting in a condition of good yield of fine fibers. The mat is sent to suction roll 12 under such conditions. Function of the down stream equipment is same as that of prior art. It will be clear that the drainage at both sides by good yield rolls does not impair characteristics of the formed mat. However, in consideration of treatment of white water (shown by arrow mark A in FIG. 1) drained towards the outside of the roll, more inclined wire run (direction of the wire proceeding) at the contact point of wire 2 on suction roll 12 makes the treatment easier. (For reference, $\gamma'$[FIG. 1]$>\gamma$[FIG. 5])

The present invention is composed as explained hereinabove, thus, the yield is improved by separating the places for drainage to the machine side from the places for fiber dispersion in drainage by the fixed hydroextractors in a sheet-forming apparatus for a paper machine. Further, drainage zones for both sides of paper are separated and respective drainage control is possible. Moreover, by arranging said hydroextractors alternately in the two wire loops, difference between top side and back side of the paper is improved and life of both wires become nearly same because both wires run along the similar fixed hydroextractors. Therefore, the life of both wires becomes nearly the same and the shut down period of time of the machine is abridged.

The present invention has been explained by way of the above preferred embodying examples, but shall not be limited thereby. All the modifications, alternations and additions within the technical scope of the present invention are included in the present invention.

What is claimed is:

1. In a twin wire paper sheet-forming machine having two moving wires having a line of travel, means for introducing a raw material of water and fibers to be formed into paper between the wires, and hydroextractor means for removing the water from the raw material, the hydroextractor means having a plurality of shoe blades with land portions which contact a respective wire, the improvement which comprises:

the hydroextractor means comprising at least two hydroextractors, the land portions of one of said at least two hydroextractors contacting one wire and the land portions of the other of said at least two hydroextractors contacting the other wire, the at least two hydroextractors being spaced alternately from one another along the line of travel of the wires, and wherein the lands of the shoe blades are contoured, each land having a front leading portion and a trailing back portion, a mid-portion located between the front portion and the back trailing portion, said front leading portion being flat and coinciding with the line of travel of the wire, said mid-portion having a wedge shaped trough therein, with the depth of the trough decreasing from the front to the back of the land, the at least two hydroextractors being structured and arranged such that on contact of a respective wire with the front leading portion of each land, the wires proceed onto the front leading portion of each land without bending at a leading edge thereof, and with the wires bending on the mid-portion or trailing back portion of each land.

2. The machine of claim 1 wherein the trailing back portion of each land slopes away from the respective wire along the line of travel of the wire.

3. The machine of claim 1 wherein the second hydroextractor in line of travel of the respective wire has an adjustable support means to adjust the angle of contact of the leading portion of the lands thereof so as to avoid bending of the wire upon making contact with the shoe blades of the second hydroextractor.

* * * * *